United States Patent [19]

Hoard et al.

[11] 4,404,946

[45] Sep. 20, 1983

[54] METHOD FOR IMPROVING FUEL CONTROL IN AN INTERNAL COMBUSTION ENGINE

[75] Inventors: John W. Hoard, Livonia; Richard R. Tuttle, Utica, both of Mich.

[73] Assignee: Ford Motor Company, Dearborn, Mich.

[21] Appl. No.: 317,671

[22] Filed: Nov. 2, 1981

Related U.S. Application Data

[63] Continuation-in-part of Ser. No. 79,293, Sep. 27, 1979, abandoned.

[51] Int. Cl.[3] ..... F02D 5/00

[52] U.S. Cl. ..... 123/486; 123/478

[58] Field of Search ..... 123/437, 438, 458, 440, 123/478, 480, 486, 488, 489, 494, 463

[56] References Cited

U.S. PATENT DOCUMENTS

| | | | |
|---|---|---|---|
| 2,623,509 | 12/1952 | Gold et al. | 123/463 |
| 3,969,614 | 7/1976 | Moyer et al. | 123/480 |
| 4,086,884 | 5/1978 | Moon et al. | 123/480 |
| 4,112,879 | 9/1978 | Assenheimer et al. | 123/488 |
| 4,269,156 | 5/1981 | Drellishak | 123/440 |

OTHER PUBLICATIONS

"Ford's 1980 Central Fuel Injection System", by G. H. Czadzeck and R. A. Reid, SAE Paper 790742.

Carburation vol. II Spark-Ignition Engines: Fuel Injection Development, Charles H. Fisher, 1966, pp. 114–117.

*Primary Examiner*—Charles J. Myhre

*Assistant Examiner*—Andrew M. Dolinar

*Attorney, Agent, or Firm*—Peter Abolins; Robert D. Sanborn

[57] ABSTRACT

A method for improving fuel control in an internal combustion engine employs a pressure ratio to determine the engine's actual volumetric efficiency continuously as the engine is operating. The air/fuel ratio of the engine's combustible mixture is affected by the volumetric efficiency. The volumetric efficiency varies during engine operation. Determination of the actual volumetric efficiency on a real-time basis allows greater accuracy in fuel metering. The pressure ratio used in the determination of the volumetric efficiency is the ratio of the intake and exhaust pressures or the inverse of this ratio. The ratio of pressures is combined with a second factor representative of the forces acting upon the air or air/fuel mixture inducted into the engine. The pressure ratio may be obtained without actual measurement of the pressure in the engine's exhaust conduit.

5 Claims, 3 Drawing Figures

VOLUMETRIC EFFICIENCY

| PIOPE | 512. | 768. | 1024. | 1280. | 1536. | 1792. | 2048. | 2304. | 2506. | 2816. | 4090. |
|---|---|---|---|---|---|---|---|---|---|---|---|
| 1.00 | .80 | .97 | .99 | .99 | .99 | .91 | .86 | .85 | .85 | .85 | .85 |
| .84 | .60 | .93 | .96 | .97 | .94 | .92 | .89 | .89 | .88 | .88 | .88 |
| .68 | .84 | .87 | .91 | .90 | .91 | .92 | .92 | .90 | .89 | .86 | .82 |
| .52 | .79 | .84 | .89 | .90 | .98 | .88 | .87 | .87 | .87 | .85 | .75 |
| .36 | .74 | .80 | .83 | .81 | .81 | .81 | .81 | .82 | .82 | .81 | .55 |
| .20 | .74 | .82 | .90 | .82 | .83 | .79 | .73 | .75 | .74 | .76 | .80 |

RPM

FIG. 2

METHOD FOR IMPROVING FUEL CONTROL IN AN INTERNAL COMBUSTION ENGINE

CROSS REFERENCE TO RELATED APPLICATIONS

This is a continuation-in-part of application Ser. No. 79,293, filed Sept. 27, 1979, now abandoned.

This invention is related to commonly-assigned U.S. Pat. No. 3,969,614 to Moyer et al. issued July 13, 1976 and entitled "Method and Apparatus for Engine Control" and to commonly-assigned U.S. Pat. No. 4,086,884 to Moon et al. issued May 2, 1978 and entitled "Method and Apparatus for Controlling the Amount of Fuel Metered into an Internal Combustion Engine".

BACKGROUND

This invention relates to a method for improving fuel control in an internal combustion engine. More particularly, it relates to a method for improving the manner in which fuel is metered in an internal combustion engine fuel control system of the speed-density type.

There are two types of systems for controlling electrically the amount of fuel metered to an internal combustion engine. One of these is the mass air flow system, in which the volume or mass of air flowing into an engine is actually measured and the fuel is metered accordingly. The other system, speed-density, uses engine speed and the engine intake manifold absolute pressure to determine indirectly the amount of air entering an engine. In both types of electronic fuel control systems, the appropriate quantity of fuel is metered with a suitable fuel control apparatus. This apparatus typically has been a plurality of electromagnetic fuel injectors intermittently operated to deliver fuel into the intake manifold upstream of the usually provided intake valves.

In the speed-density fuel control system described in the aforementioned U.S. Pat. No. 4,086,884, the fuel control system employs a digital computer to calculate the amount of fuel required by the engine. The calculation is done repetitively to permit the fuel supply to be adjusted sufficiently often so that adequately precise control of fuel is achieved on a real-time basis. The computer preferably controls fuel in an interactive manner, that is, fuel supply, ignition timing and exhaust gas recirculation all are controlled simultaneously as interdependent output variables. The aforementioned U.S. Pat. No. 3,969,614 describes an interactive engine control system. In such a digital computer engine control system, an output variable, such as ignition timing, is taken into account in the determination of another output variable, such as the time and duration of injection in an intermittent-type fuel injection system. (If the injection is continuous, of course, determination of the usual points in the engine cycle at which injection is to be initiated is unnecessary.) The speed-density fuel injection system described in U.S. Pat. No. 4,086,884 requires that the volumetric efficiency of the engine be used, directly or indirectly, in the calculation of the quantity of fuel to be supplied to the engine. Unfortunately, the volumetric efficiency is a function of several parameters including engine speed and engine load. This means that these changing factors have had to be taken into account in the calculation of the quantity of fuel to be metered to the engine to satisfy the oxygen content of the intake mixture that actually enters the engine's combustion chambers. The desired fuel amount at any given time may, of course, be selected to provide a rich, a stoichiometric or a lean air/fuel mixture as may be required for engine operation in an open or closed-loop mode of engine operation.

A system using "speed-density" means that the system measures engine speed and intake charge density and a predetermined value for volumetric efficiency to calculate air flow. Based on dynamometer data for a particular 5 liter engine, the mathematical expression for this is:

$$\text{Total Mass Flow (Airmass} + EGR \text{ Mass, or } AMPEM) = \frac{.11346 \times MAP \times RPM}{MCT} \times VEFF \quad (1)$$

where:

MAP = Manifold Absolute Pressure from MAP sensor

RPM = Engine Speed—from CP sensor

MCT = Manifold Charge Temperature (used for density correction) from MCT sensor.

VEFF = Volumetric Efficiency for the engine from a look up table stored in the ECU. The value taken for VEFF is dependent on RPM and MAP.

To get the airmass from the above expression EGR mass must be subtracted. In an ideal engine having an efficiency, VEFF, of 1 and a more generalized proportionality constant, K, the equation reduces to $$\text{Total Mass Flow} = (K)(MAP)(RPM)/MCT. \quad (2)$$

This is a simple expression for the calculation of air mass flow using the speed-density approach That is, the speed is relating to engine RPM and the air density is related to pressure (MAP) and temperature (MCT). The proportionality constant K typically takes into account such factors as the volume of the engine, the number of cylinders filled per revolution and the units of the calculation.

The improved method of the present invention permits the volumetric efficiency of an engine having a speed-density electronic fuel control system to be determined much more accurately, under varying engine operating conditions, than is the case in the prior art systems. As a result, much more accurate fuel control is made possible and desired fuel economy and emission control benefits may be realized under certain circumstances.

The method of the invention improves fuel control in an internal combustion engine by providing for the computer calculation of an engine's current volumetric efficiency. The volumetric efficiency varies as a function of engine operating parameters, such as engine load, engine speed and other less significant variables. Specifically, the improved method of the invention comprises the steps of determining the ratio of the pressure in an engine's intake manifold to the absolute pressure of the products of combustion in a passage through which the products of combustion pass after leaving the engine's combustion chamber or chambers. This ratio of intake mixture and exhaust gas absolute pressures, or the inverse ratio, is combined mathematically with a second factor, which may be related to the engine speed, representative of forces acting upon the intake mixture as it flow toward the combustion chambers. The combined ratio and second factor are used to determine the volumetric efficiency of the engine with respect to the flow of gases into at least one combustion chamber thereof. This real-time volumetric efficiency then may be used to determine the amount of fuel metered to the engine.

The method of the invention is of value as compared to the prior art because of the simplicity and accuracy with which an engine's current volumetric efficiency can be determined. The ratio of the intake mixture and exhaust gas pressures is easily determined with the use of sensors typically found on engines having speed-density fuel control systems. Also, the engine speed is a variable that is readily available on a continuous basis in electronic engine control systems. The prior art speed-density systems, in contrast, have required the use of many time-consuming calculations, either digital or analog or both, based upon approximations of engine characteristics and design features. The system described in Moon et al. U.S. Pat. No. 4,086,884 mentioned above avoided this. The volumetric efficiency was treated as a function of temperature and pressure conditions in the intake manifold at the time the quantity of fuel to be delivered to the engine, i.e., the injector pulse width, was being calculated.

A very significant feature of the invention is that the real-time determination of volumetric efficiency takes into account the effects of changes in altitude on the characteristics of an engine's operation.

BRIEF DESCRIPTION OF THE DRAWINGS

FIG. 2 is a table of values suitable for use in accordance with an embodiment of this invention.

DETAILED DESCRIPTION

Figure 1A:
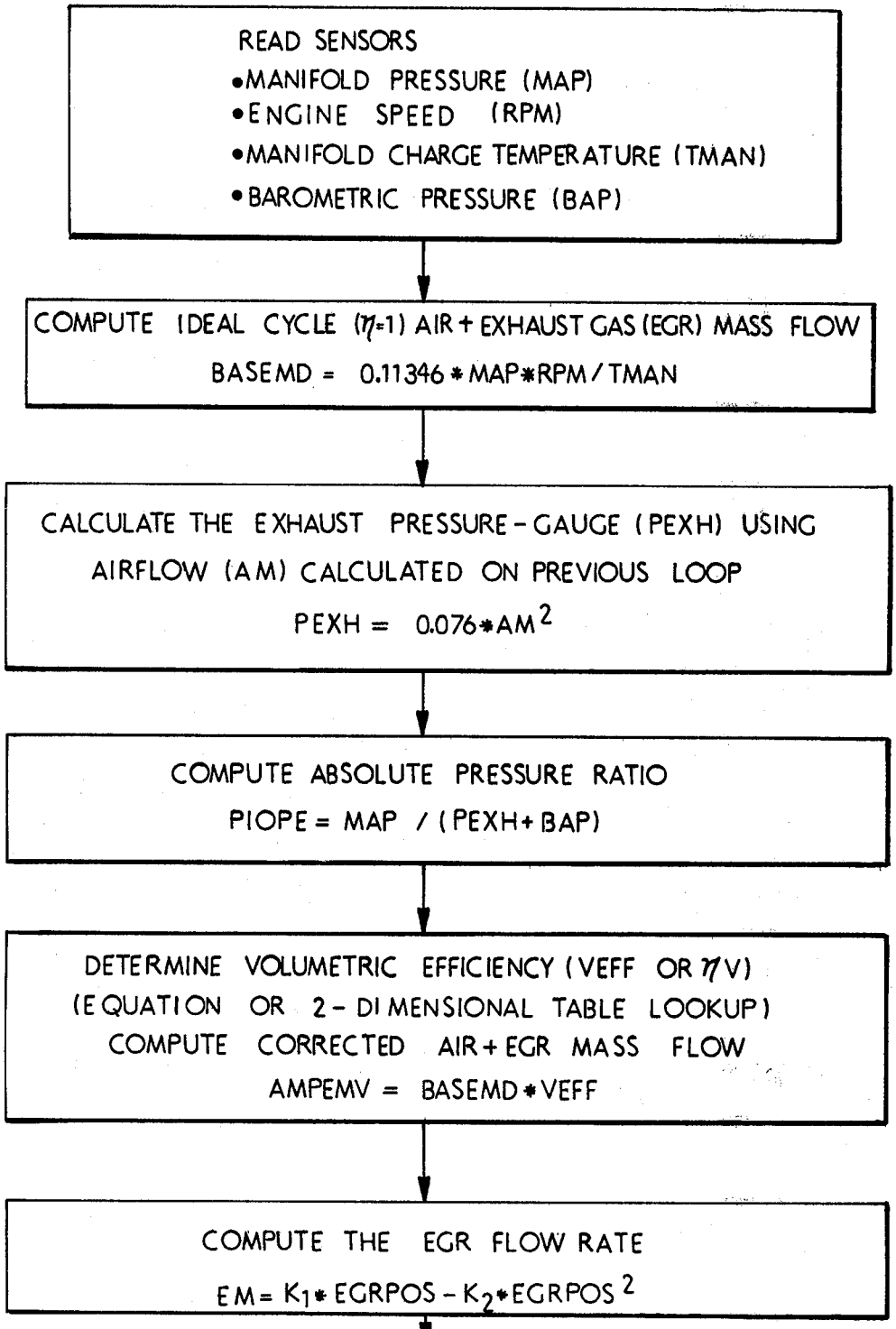
FIGS. 1A and 1B are a logic flow block diagram in accordance with an embodiment of this invention.
Figure 1B:
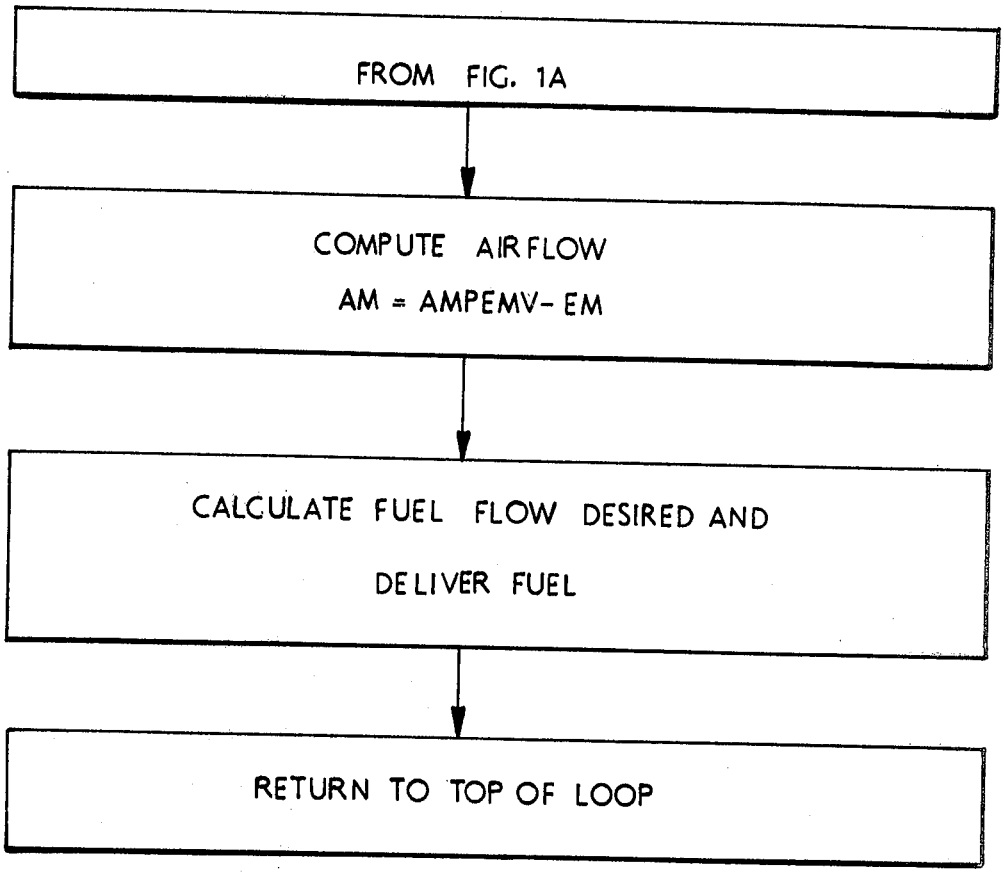

The prior art calculation of the quantity of fuel to be supplied to an engine employing a speed-density fuel control system, whether accomplished with analog electronic circuitry or with a digital computer and associated software or a combination of these, has been based primarily on the speed of the engine and the intake manifold pressure at the time the calculation is made. In these prior art control systems for spark-ignition internal combustion engines, the other parameters of engine operation have been regarded as being of substantially lesser significance. The other parameters are less variable, generally speaking, and consequently can be treated as environmental conditions that should be taken into account for purposes of accuracy and calibration. The more extreme modes of engine operation, such as occur during engine cranking at start, cold-engine warm-up and wide-open throttle, usually have been treated as situations requiring separate control provisions. Because catalysts of the three-way type now are used extensively in automotive engines and because exhaust gas recirculation makes the oxygen content of the intake mixture less predictable under all conditions of engine operation, the use of engine speed and intake manifold pressure alone to determine the quantity of fuel to be supplied to an engine no longer is satisfactory, whether or not the denisty of the intake mixture is taken into account.

The system disclosed in Moon et al. U.S. Pat. No. 4,086,884 was intended to improve the speed-density fuel control system by taking into account the effect of exhaust gas recirculation on the amount of fuel required by an engine. This much improved system also was designed to allow the slowly varying parameters of engine operation, such as volumetric efficiency, to be updated less frequently than the more rapidly varying parameters, such as intake manifold pressure and the quantity of recirculated exhaust gas. The method of the present invention carries the development of electronic fuel metering an additional step by providing an effective way to allow an engine's volumetric efficiency to be monitored on a real-time basis.

The volumetric efficiency of the engine can be of great significance where precise control of the air/fuel ratio of the mixture supplied to an engine is required. If fuel economy, engine performance and exhaust emissions are of concern, air/fuel mixtures must be precisely controlled over a range of rich, stoichiometric and lean air/fuel ratios. The volumetric efficiency of an engine is the volume of gaseous material that enters the combustion chamber or chambers of an engine divided by the displacement volume of such combustion chamber or chambers of the engine; the volume of gaseous material entering the engine is referenced to a selected temperature and pressure and in effect is a mass flow. This definition is useful here in that it indicates that volumetric efficiency, for an engine of fixed displacement, is dependent only upon the volume of gaseous material that enters the combustion chamber or chambers of the engine. Necessarily, this volume is not the same as the volume exhausted because additional gases are formed during combustion.

Volumetric efficiency of an engine in the past has been determined primarily from the intake manifold absolute pressure and the engine speed based upon accumulated engine dynamometer data for a given engine and exhaust system design. Every variation in intake manifold pressure changes the volumetric efficiency; intake manifold pressure is a function of both engine speed and engine load, as well as the density of the gaseous mixture in the manifold.

The inventors have found that volumetric efficiency, regardless of engine operation in geographical locations of widely varying altitudes, is related to the ratio of the intake manifold absolute pressure and the engine exhaust system absolute pressure immediately downstream of the combustion chamber. The relationship is almost hyperbolic. If the ratio is inverted, it is almost linear. Otherwise stated, the ratio of intake manifold absolute pressure to the absolute pressure in the engine's exhaust conduit, when combined with a second factor, can be used to determine volumetric efficiency. The second factor represents the frictional and inertial forces that are resisting the flow of the gaseous intake mixture entering the combustion chamber or chambers of the engine.

All of the gaseous mixture entering the engine's intake system and flowing toward the engine's combustion chamber or chambers travels through the engine's intake conduit or manifold before passing through the respective intake valves and into the corresponding combustion chambers. There is resistance to this flow in the form of frictional and inertial forces. The frictional forces are the result of the interaction of the fluids entering the combustion chambers with the intake conduit and the intake valves.

Volumetric efficiency of an engine is a measure of the quantity of gaseous material inducted into a combustion chamber or chambers. Accurate determination of the volumetric efficiency makes possible delivery of exactly the right amount of fuel to the combustion chambers to satisfy the requirements of the air or oxygen in the combustion chambers. In other words, exact knowledge of an engine's volumetric efficiency throughout the operation of the engine allows the proper amount of fuel for the oxygen entering the combustion chamber or chambers during each cycle of the engine to be calculated and delivered.

The pressure ratio of the engine can be expressed by a pnemonic suitable for use in computer programming. Thus, it may be represented as PIOPE, which means intake conduit absolute pressure, over or divided by exhaust conduit absolute pressure.

The pressure ratio also can be represented pnemonically in other ways. For example, the pressure ratio may be written as PEOPI, meaning exhaust pressure over or divided by intake pressure; the PEOPI is a pressure ratio, as is PIOPE. Volumetric efficiency VEFF preferably is related to PEOPI as follows:

$$VEFF=[(PEOPI)(K_1)+K_2](\text{second factor}). \quad (3)$$

In this equation, $K_1$ and $K_2$ are constants. The second factor represents the frictional and inertial forces acting on the air, or air and exhaust gas, or air, exhaust gas and fuel mixture moving within the intake conduit toward the intake valves and combustion chambers.

Whatever the pnemonic representation in the digital computer computation of volumetric efficiency or its equivalents, the significant factor is the use of the PIOPE or PEOPI ratio of absolute pressures. These pressures in ratio and when combined with a second factor provide direct and accurate indications of current or real-time engine volumetric efficiency, i.e., volumetric efficiency as of the time the absolute pressures are determined. (This, of course, assumes the intake and exhaust conduit pressures are measured or determined at the same or insignificantly different times). The second factor mentioned above is representative of the dynamic forces of friction and inertia that act upon, and tend to retard the flow of, the gaseous mixture in the engine's intake conduit; these forces are proportional to engine speed and other engine operating paratmeters of lesser significance. The second factor, and also the constants $K_1$ and $K_2$ above, can be determined by multiple regression analysis of data obtained by testing a particular engine design on an engine dynamometer. This method for determining the second factor typically results in the second factor being defined by a quadratic equation, having known constants $K_3$, $K_4$ and $K_5$, as follows:

$$\text{second factor}=K_3+(K_4)(\text{engine RPM})+(K_5)(\text{engine RPM}^2).$$

A particularly suitable method for determining volumetric efficiency on a real-time basis is with the aid of values placed in computer memory in tabular form as a function of PIOPE and engine speed. The PIOPE and engine speed may be represented as binary numbers used to obtain access to a value or values of volumetric efficiency retained in computer memory. Well known techniques preferably are employed to interpolate between volumetric efficiency values stored in the memory; four-point interpolation is most accurate. The accessed volumetric efficiency value then can be used in a computer program for determining required fuel delivery. An example of a suitable equation for use in calculating fuel injection pulse width using the engine's volumetric efficiency, in a speed-density system, is given in Moon et al. U.S. Pat. No. 4,086,884. Engine period and PEOPI, or some other suitable combination of pressure ratio with a second factor that together reflect the engine's current operational volumetric efficiency, can be used to obtain the fuel delivery required for such current volumetric efficiency.

In the determination of the absolute pressure ratio, it is not necessary to actually measure the absolute pressure in the exhaust conduit of the engine. The intake manifold absolute pressure is a quantity that is routinely used and available in known speed-density fuel injection systems for spark-ignition internal combustion engines. The ambient or barometric pressure also is available in such systems. The engine's combustion chamber displacement is a constant equal to the current mass flow of gases into the engine divided by the volumetric efficiency of the engine as calculated on the last cycle of the engine. (It should be noted that the exhaust conduit back pressure also is very much related to the mass flow of gases into the engine's combustion chamber or chambers immediately before it is exhausted to produce the exhaust pressure. This is a factor in determining the volumetric efficiency for the next succeeding engine cycle.) The mass gas flow into the engine or volumetric efficiency for a preceding cycle may, therefore, be used to determine the volumetric efficiency for a succeeding cycle. To do this, the displacement of the engine's combustion chambers may be divided by the volumetric efficiency last determined to yield a number approximately equal to the actual gas flow through the engine per complete engine cycle. If then this number is multiplied by the number of engine cycles per unit time (usually RPM/2), the gas flow rate through the engine is found. This flow rate may include recirculated exhaust gas and the amount of its contribution to the gas flow rate may be subtracted as taught in the Moon et al. U.S. Pat. No. 4,086,884. The exhaust conduit gage pressure is a simple quadratic function of engine air mass flow rate, that is, exhaust conduit gage pressure is equal to a constant times the square of the air mass flow rate. The absolute value of the exhaust pressure is the gage pressure plus the known or sensed barometric pressure. Following this, the ratio PIOPE or PEOPI can be obtained with the use of the most recently available intake manifold absolute pressure and the calculated exhaust conduit absolute pressure. The ratio then is used, in combination with the aforementioned second factor representing frictional and inertial forces, to produce a new engine volumetric efficiency value. The calculation is repeated continually during engine operation.

If it is desired to use the digital computer program and memory for more than one engine or vehicle system without changing the volumetric efficiency table that is selected, this can be accomplished by the use of scaling factors and terms in the basic equation that relates mass air flow into the engine's combustion chambers to the exhaust system gage pressure. For this purpose, the exhaust system gage pressure may be regarded as a term that is equal to the sum of a constant and two or more other terms each having air mass flow as a factor with a coefficient that is selected for the particular engine or vehicle system in question.

For the sake of clarity, the following example of a calculation is given:

(a) measure intake conduit pressure value (MAP), engine speed (RPM) and manifold charge temperature (TMAN);

(b) calculate ideal cycle gas flow assuming an ideal volumetric efficiency (Nv) of 1.0. In the following equation, BASMD is the basic gas flow and $K_1$ is a constant intake $BASEMD=(K_1)(MAP)(RPM)/(T\text{-}MAN)$;

(c) calculate the exhaust gage pressure (PEXH) (i.e., the pressure above atmospheric pressure) using a previously calculated airflow (AM): $PEXH=(K_2)(AM^2)$, wherein $K_2$ is a constant and AM=0.0 is used for first calculation;

(d) determine the value of Barometric Absolute Pressure (BAP) from a sensor;

(e) calculate the ratio of intake absolute pressure over the exhaust absolute pressure PIOPE, using $PIOPE=MAP/(PEXH+BAP)$;

(f) determine the value of the volumetric efficiency (Nv or VEFF) as a function of PIOPE and RPM (table look up or the equation numbered (3) above);

(g) calculate the actual gas flow, AMPEM, into the engine which is equal to BASEMD times the volumetric efficiency (VEFF),or $AMPEM=BASEMD\times VEFF$;

(h) calculate the EGR mass flow (EM) from the EGR pintle position (EGR POS) i.e., $EM=(K_3)(EGR\ POS)-(K_4)(EGR\ POS^2)$ wherein $K_3$ and $K_4$ are constants;

(i) calculate the actual air flow $AM=AMPEM=EM$;

(j) use the last calculated AM value to calculate PEXH in the next calculation loop;

(k) meter fuel proportional to the last calculated AM.

Based upon the foregoing description of the invention, what is claimed is:

1. A method for improving the fuel control of an internal combustion engine having an intake conduit and an exhaust conduit, the method comprising the steps of:

(a) measuring the intake conduit pressure value;

(b) establishing an exhaust conduit pressure value;

(c) determining the ratio between the engine's intake conduit pressure value and its exhaust conduit pressure value;

(d) using the determined ratio to determine the volumetric efficiency value of the engine, the volumetric efficiency value being determined with respect to the flow of gases into at least one combustion chamber of the engine;

(e) calculating the air mass flow into the engine based upon such determined volumetric efficiency value;

(f) metering fuel to the engine in a quantity based upon such calculated air mass flow; and when a value for air mass flow is available said steps of establishing an exhaust conduit pressure value including calculating the exhaust conduit pressure using the latest available air mass flow.

2. A method according to claim 1 wherein the sequence of steps recited therein is repeated and said step of establishing an exhaust conduit pressure value includes:

calculating the exhaust conduit pressure a first time assuming a value of zero for air mass flow; and calculating the exhaust conduit pressure subsequent to the first time using the most recently available air mass flow determined in step (e) of claim 1.

3. A method according to claim 1 wherein the volumetric efficiency value is established from data contained in a table stored in the memory of a digital computer as a function of the ratio between the engine's intake conduit pressure value and the engine exhaust conduit pressure value, and as a function of engine speed.

4. A method according to claim 1 wherein the pressure ratio and a second factor are combined to obtain the volumetric efficiency value determined in accordance with step (d) in claim 1.

5. A method according to claim 4 wherein the pressure ratio together with said second factor representing the frictional and inertial forces acting upon the mixture of gases flowing through the engine's intake conduit are used to obtain the volumetric efficiency value determined in accordance with step (d) in claim 1.

* * * * *